US010512293B2

(12) United States Patent
Hiskey

(10) Patent No.: US 10,512,293 B2
(45) Date of Patent: Dec. 24, 2019

(54) HAIR WEAVE APPARATUS AND METHOD

(71) Applicant: Kathryn Hiskey, San Diego, CA (US)

(72) Inventor: Kathryn Hiskey, San Diego, CA (US)

( * ) Notice: Subject to any disclaimer, the term of this patent is extended or adjusted under 35 U.S.C. 154(b) by 0 days.

(21) Appl. No.: 14/595,209

(22) Filed: May 26, 2015

(65) Prior Publication Data

US 2015/0296911 A1 Oct. 22, 2015

Related U.S. Application Data

(60) Provisional application No. 61/926,361, filed on Jan. 12, 2014.

(51) Int. Cl.
*A41G 5/00* (2006.01)

(52) U.S. Cl.
CPC ..... *A41G 5/006* (2013.01); *A41G 5/004* (2013.01)

(58) Field of Classification Search
CPC ..... A41G 5/004; A41G 5/0046; A41G 5/006; A41G 5/0066
See application file for complete search history.

(56) References Cited

U.S. PATENT DOCUMENTS 1,526,440 A * 2/1925 Skaruda ..... A41G 5/004 132/105
1,549,334 A * 8/1925 Ruffio ..... A41G 5/004 132/105
4,016,889 A * 4/1977 Cowles ..... A41G 5/004 132/56
9,113,669 B1 * 8/2015 Kleinman ..... A41G 5/0073
2008/0163882 A1 * 7/2008 Owens ..... A41G 5/0046 132/201
2012/0260933 A1 * 10/2012 Ourique ..... A41G 5/006 132/201
2013/0180540 A1 * 7/2013 Di Biase ..... A41G 5/0046 132/201
2014/0326267 A1 * 11/2014 Peterson ..... A41G 5/0046 132/201

FOREIGN PATENT DOCUMENTS

DE 102010011333 * 9/2011
GB 572226 * 11/1944
KR 101368868 * 2/2014

OTHER PUBLICATIONS

Everything Plastic Canyas,http://everythingplasticcanyas.com/plastic-canyas-5-mesh-1325-x-22-mrp-p20123.aspx, Sep. 23, 2010.*

* cited by examiner

*Primary Examiner* — Tatiana L Nobrega
*Assistant Examiner* — Brianne E Kalach
(74) *Attorney, Agent, or Firm* — NORTHSTAR LAW GROUP; Thomas Bassolino

(57) ABSTRACT

Embodiments of the present teachings address torn hair from a person's scalp when receiving hair extensions by absorbing the mechanical stress of affixing such hair weft extensions to a person's scalp. The hair weave apparatus of the present disclosure comprises a first side, adapted to be affixed to a plurality of hair wefts, a second side, adapted to be affixed to a plurality of hair braids organized in parallel, and a plurality of apertures.

7 Claims, 5 Drawing Sheets

100

100

100

HAIR WEAVE APPARATUS AND METHOD

This non provisional patent application claims the benefit of priority to U.S. provisional patent application entitled, "HAIR WEAVE APPARATUS AND METHOD", filed Jan. 12, 2014, having Ser. No. 61/926,361 and is incorporated by reference in its entirety.

FIELD

The present disclosure relates to apparatuses and methods for weaving hair extensions onto a person's head.

BACKGROUND

It has become growingly common for people to incorporate hair extensions into their natural hair for a variety of reasons. Some people may be losing hair due to age, cancer or other reasons, while still other people may simply desire to have longer hair without the need to grow their hair long permanently.

One problem with previous solutions to providing hair extensions arises when the person desiring to have hair extensions woven into their natural hair can sustain broken or torn hair due to the tension required to sew the extensions into the person's scalp. That is, there is a certain minimum amount of tension that a hairdresser must apply to a client's natural hair when sewing or weaving the extensions, which can lead to broken or damaged hair. This is particularly concerning for persons whom already have compromised hair strength. Also, people who regularly obtain hair extensions are more susceptible to hair loss due to extensions, due to the long term tension the sewn on hair extensions exert on a person's scalp.

Additionally, previous hair extension solutions do not always lead to a desired fuller, more natural looking head of hair for a user, as they depend on the limitations of a person's natural hair edges.

The present teachings address these issues and provide a better solution than current, state of the art solutions provide, as will now be disclosed.

SUMMARY

A hair weave apparatus, adapted to be affixed to a plurality of hair braids organized in parallel, comprising: a first side, adapted to be affixed to a plurality of hair wefts; a second side, adapted to be affixed to the plurality of hair braids organized in parallel, and; a plurality of apertures, adapted to accept the plurality of hair wefts therein, further adapted to accept the plurality of hair braids organized in parallel therein.

BRIEF DESCRIPTION OF THE DRAWINGS

Embodiments of the present disclosure will be more readily understood by reference to the following figures, in which like reference numbers and designations indicate like elements.

DETAILED DESCRIPTION

The purpose of this invention is to aid a hairdresser in performing the hair extensions without tearing and damaging client's hair edges and creating a fuller and healthier look. This invention is sewn around the edges of a person's prepared cornrow braids called tracks. Types of hair extensions, called wefts, are sewn on the tracks and are secured with the aid of the invention on the end of each row. Weft hair extensions are rows of hair that are sewn onto a client's natural hair. This type of hair extension has to be secured on the edges and causes hair loss and or balding on those areas that have had continuous pulling and tightening.

The present invention takes the pressure from the tight sewing and knotting that would generally end up on the edges of the client's hair line and it extends the tracks to create more room for the weft of hair, creating a fuller healthier look without damaging the client's edges.

There are items that have been created in aid to help the hairdresser apply the wefts to cover the balding edges and make the client appear to have healthy looking hair again. But these items do not substantially protect the client's own hair from tearing at the edges. This invention takes on all of the pressure that would normally go onto the client's edges where the tearing would have taken place and it fills the balding areas securely with a special material that does not allow any pulling. People that would use the invention are hair extension experts and beauty supplies. The benefits that the users would receive are a tool to stop tearing out their client's natural hair, the ability to work with balding issues, preventing new clients from tearing their edges, creating fuller and more natural looking sides for client.

It will be appreciated that over years of wearing hair weft extensions, the edges where the braids commence become torn and there is permanent damage and balding from years the of the weft hair extensions being sewn on. The edges receive the most damage because that is where they are tugged and pulled the most because the hairdresser has to make sure she tightens that part well so the thread doesn't come apart.

Referring now generally to FIG. 1*a*-FIG. 1*e* a hair weave apparatus 100 is disclosed.

Figure 1A:
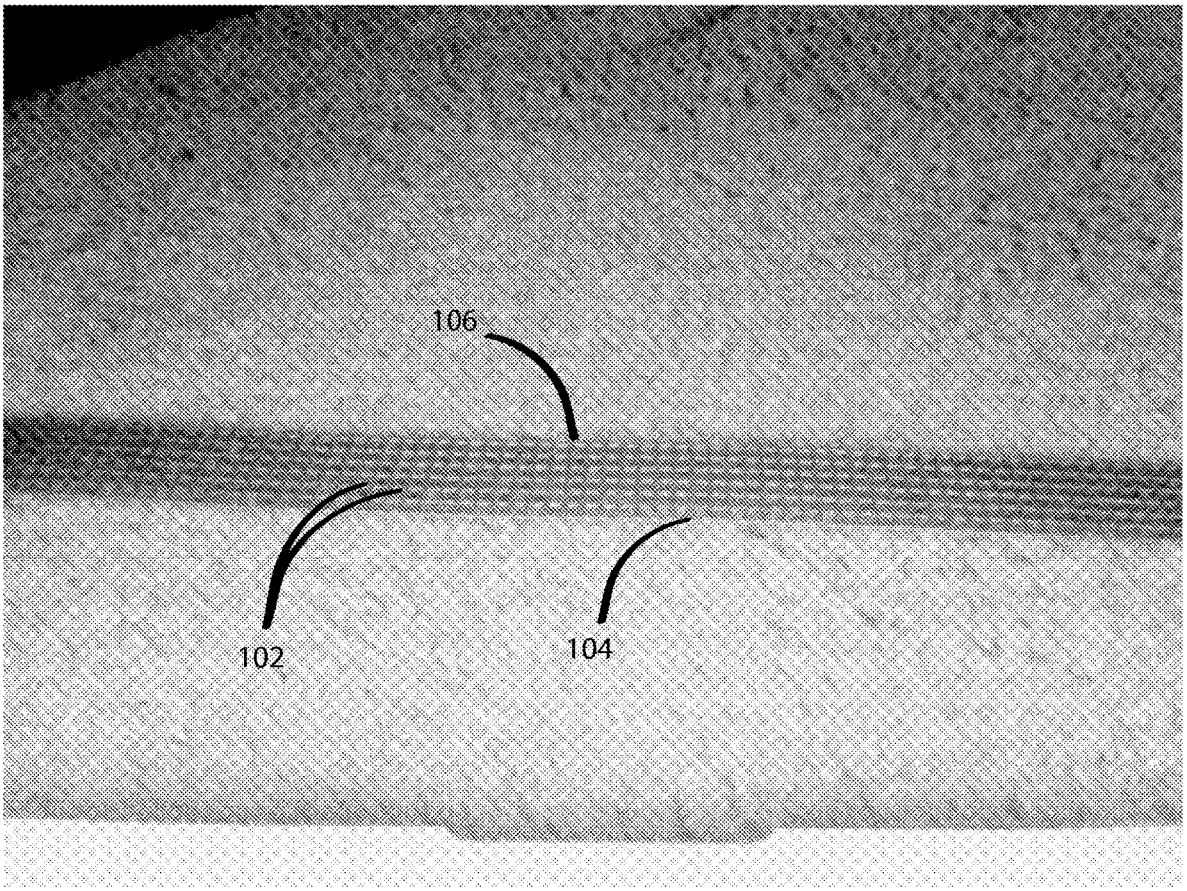
FIG. 1*a* illustrates a perspective view of a hair weave apparatus according to one embodiment of the present teachings.
Figure 1B:
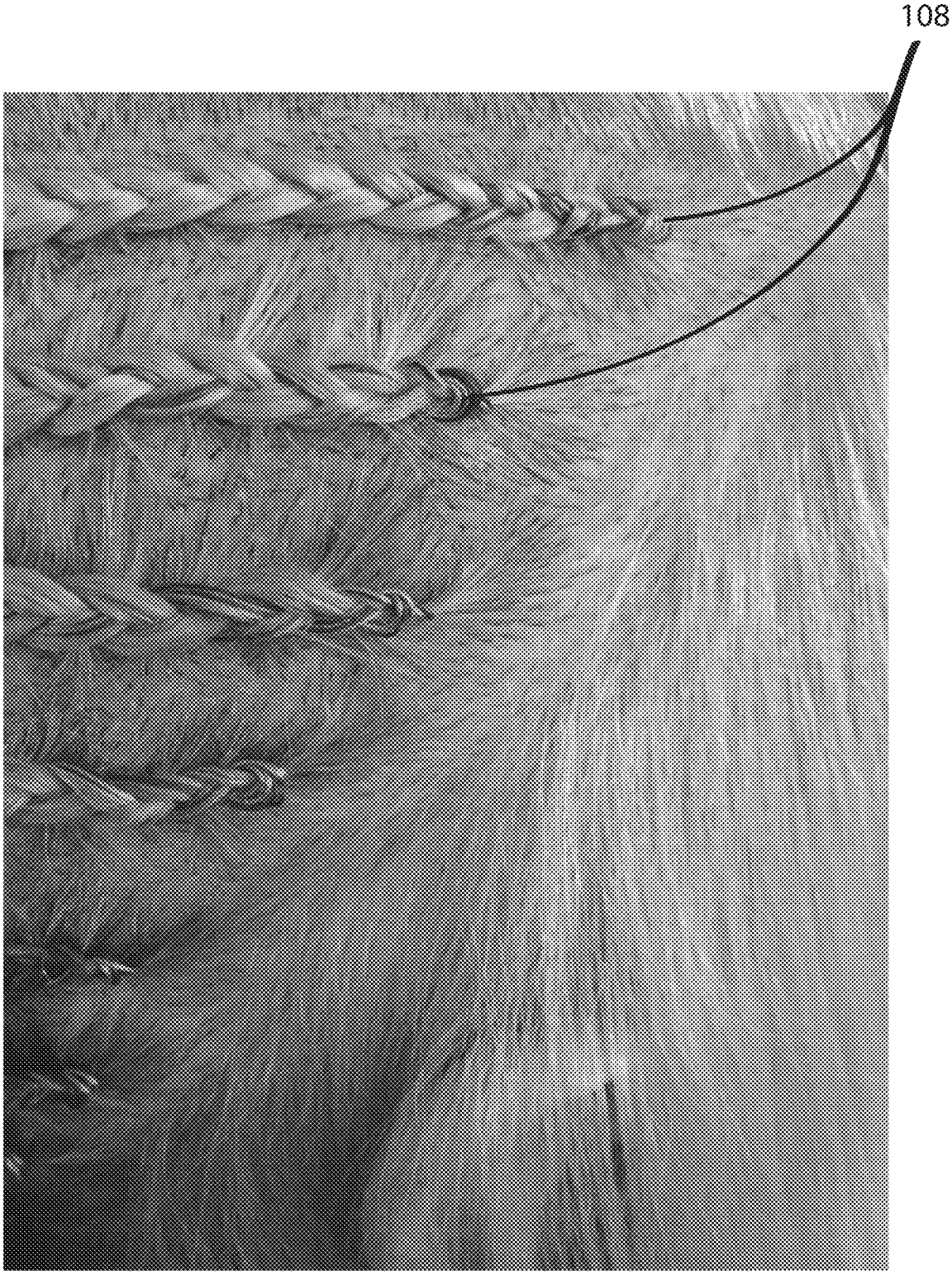
FIG. 1*b* illustrates a side view of braided hair upon which the present invention is affixed.

As illustrated in FIG. 1*a*, a hair weave apparatus 100 comprising a first side 104, a second side 106, and a plurality of apertures 102 is disclosed. FIG. 1*b* illustrates a human head having a plurality of braids organized generally in parallel, with a plurality of leading edges 108.

Figure 1C:
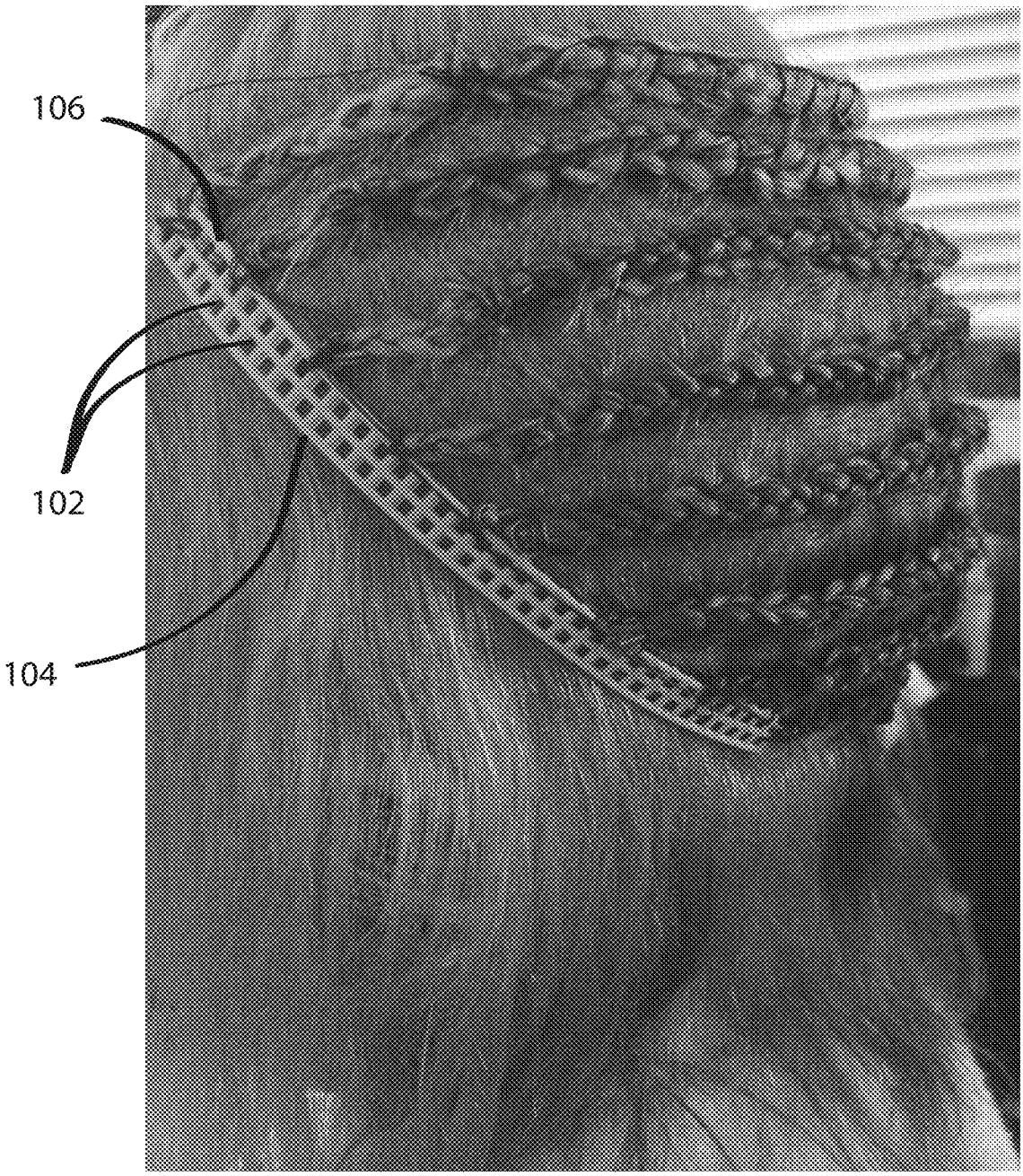
FIG. 1*c* illustrates a side plan view of a hair weave apparatus affixed to braided hair, according to one embodiment of the present teachings.

FIG. 1*c* illustrates the hair weave apparatus 100, wherein the second side 106 is affixed to the plurality of braids organized in parallel at the plurality of leading edges 108. It will be appreciated that the plurality of leading edges 108 may be affixed to the hair weave apparatus 100 by tying knots between the plurality of apertures 102 disposed along the second side 106 and the plurality of leading edges 108.

Figure 1D:
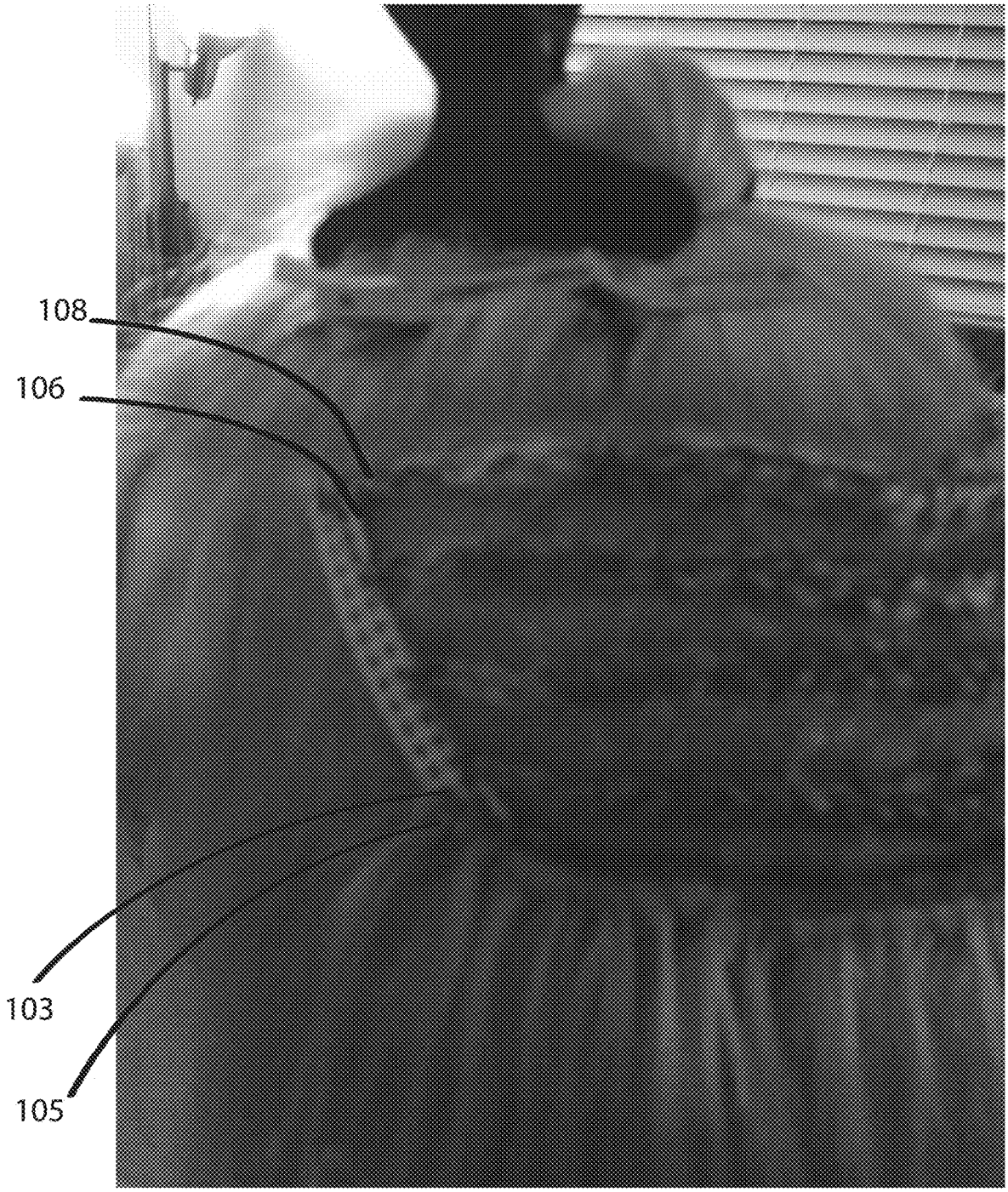
FIG. 1*d* illustrates a side plan view of a hair weave apparatus affixed to braided hair and having wefts attached thereto, according to one embodiment of the present teachings.

FIG. 1*d* illustrates a progression from FIG. 1*c*, wherein a weft 105 is affixed to an aperture 103. The hair weave apparatus 100 functions to absorb mechanical tension on the ends of each row of hair braids, which were previously absorbed by the scalp and hair roots of previous state of the art solutions, which caused damage to the hair.

Using the hair weave apparatus 100, a hairdresser progressively affixes more wefts to the apertures in such a manner as to eventually cover the hair weave apparatus 100.

Figure 1E:
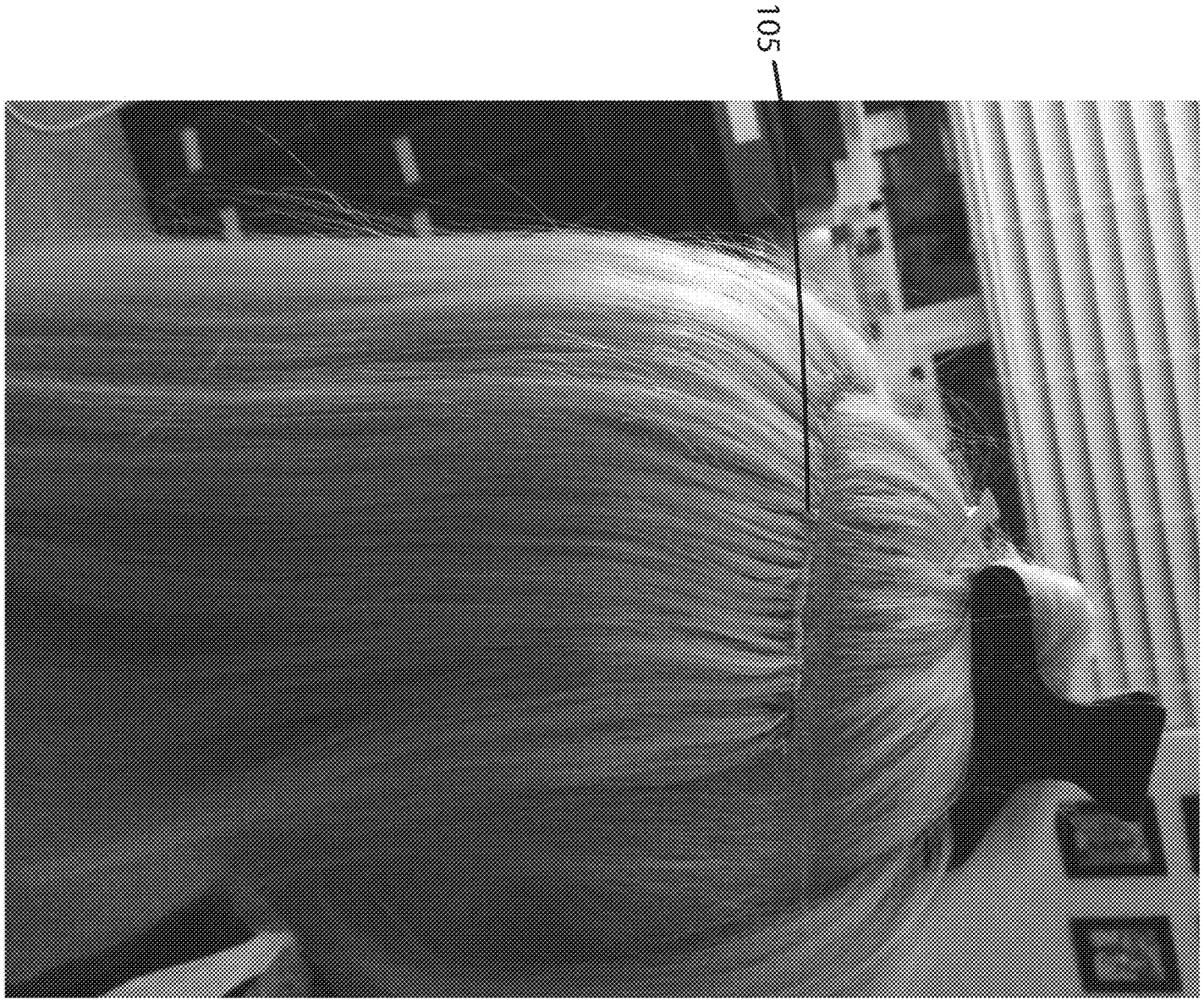
FIG. 1*e* illustrates a final view of a hair weave apparatus completely covered with wefts, according to one embodiment of the present teachings.

FIG. 1*e* illustrates a final view of multiple of the wefts 105 being affixed to the row of braids and the hair weave apparatus 100.

Using techniques as described herein, edges of the wefts are secured to the hair weave apparatus 100, alleviating the person's scalp from absorbing the mechanical stress and tension, thereby avoiding further pulling and tearing of the person's natural hair. Furthermore, by employing the hair weave apparatus 100, the hairdresser may further create additional "hair" in the areas that have been torn and/or balding, by adding additional wefts beyond the point at which the person's hair extends.

Typical in persons requiring weft hair extensions, over a period of time, such as for example 25 years in some cases, the process of adding extensions must be redone approximately every six weeks. Typically, damage over time is done on the front and top edges of the head and the sides. Often, when a person has lost so much hair a hairdresser may use a net, which was created for this type of damage. The net is used to cover up the balding areas on the scalp and wefts may be sown into the net. However, the net fails to eliminate the mechanical tension of the affixed portion of wefts, because the net is not designed to absorb such tension and has no mechanical rigidity. Therefore, a net does not resolve the hair tearing issue. A hairdresser may use a net and the hair weave apparatus 100 simultaneously, wherein the hair weave apparatus 100 functions to absorb the mechanical tension of the wefts affixing points, and the net functions to help cover balding areas of the scalp. When used in this configuration, the net may be sewn directly into the hair weave apparatus 100 and not directly into the delicate edges of the person's scalp. This protects the person's hair edges from further tearing or damage. After the net is applied, the hair dresser can continue as usual to create a full head of extensions knowing that all of the pressure and tightness of the sewing will go onto the hair weave apparatus 100 and not directly onto the person's delicate edges.

It will be appreciated that in some embodiments, the width of the hair weave apparatus 100 may be wider to compensate for a person's hair loss. That is, if a person has a substantial bald spot, the hair weave apparatus 100 may be wider to cover such an area more fully than prior art solutions allow.

What is claimed is:

1. A method for coupling hair wefts to a wearer's head, the method comprising:

braiding hair of a wearer to create a plurality of hair braids arranged substantially parallel to one another across the wearer's head from a left side of the wearer's head to a right side of the wearer's head;

affixing a first hair weave apparatus to an end of each braid of the plurality of hair braids on the left side of the wearer's head and sewing a second hair weave apparatus to an opposing end of each braid of the plurality of braids on the right side of a wearer's head such that a gap exists between the first and second hair weave apparatuses, the first and second hair weave apparatuses each including:

an elongate plastic mesh body defining a top edge, a bottom edge, left and right side edges disposed between the top and bottom edges, and at least two rows of a plurality of apertures, wherein each of the first and second hair weave apparatuses have a width between the left and right side edges and a length between the top and bottom edges and the at least two rows of the plurality of apertures extend along the length and are substantially parallel to the right and left side edges, wherein in the affixing step, i) the first weave apparatus is sewn to the left side of the wearer's head by sewing the end of each braid to the apertures along a row of the at least two rows of apertures, where the row is disposed immediately adjacent the right side edge such that the left side edge occupies a position laterally spaced from the right side edge, and ii) the second hair weave apparatus is sewn to the right side of the wearer's head by sewing the opposing end of each braid to the apertures along a row of the at least two rows of apertures, where the row is disposed immediately adjacent the left side edge such that the right side edge occupies a position laterally spaced from the left side edge;

providing a plurality of hair wefts;

securing a first hair weft of the plurality of hair wefts to one of the plurality of hair braids and to each of the first and second hair weave apparatuses by sewing opposing ends of the first hair weft to another row of the at least two rows of the plurality of apertures, such that the first hair weft is disposed across the entire width of the elongate mesh body of the first and second hair weave apparatuses to conceal them from view and sewing remaining portions of the first weft to the braid; and repeating the securing step with remaining hair wefts of the plurality of hair wefts.

2. The method of claim 1, wherein the body is rigid.

3. The method of claim 1, further comprising covering an entirety of the body of the first and second hair weave apparatuses by securing the plurality of hair wefts thereto.

4. The method of claim 1, further comprising affixing a net to the first and second hair weave apparatuses using one or more of the plurality of apertures.

5. The method of claim 1, wherein one or more of the first and second hair weave apparatuses is positioned at an edge of a hairline of the wearer.

6. The method of claim 5, wherein one or more of the first and second hair weave apparatuses mitigates pulling of the natural hair of the wearer at the hairline.

7. The method of claim 5, wherein one or more of the first and second hair weave apparatuses covers a balding area adjacent to the hairline.

* * * * *